US010094151B2

(12) United States Patent
Yoshino

(10) Patent No.: US 10,094,151 B2
(45) Date of Patent: Oct. 9, 2018

(54) DOOR HANDLE DEVICE FOR VEHICLE

(71) Applicant: Aisin Seiki Kabushiki Kaisha, Kariya-shi (JP)

(72) Inventor: Masaki Yoshino, Chita-gun (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 619 days.

(21) Appl. No.: 14/791,665

(22) Filed: Jul. 6, 2015

(65) Prior Publication Data

US 2016/0032628 A1 Feb. 4, 2016

(30) Foreign Application Priority Data

Jul. 30, 2014 (JP) ..... 2014-154591

(51) Int. Cl.
*E05B 3/00* (2006.01)
*E05B 85/16* (2014.01)
(Continued)

(52) U.S. Cl.
CPC ..... *E05B 85/16* (2013.01); *E05B 77/34* (2013.01); *E05B 77/36* (2013.01); *E05B 79/06* (2013.01);
(Continued)

(58) Field of Classification Search
CPC .. Y10S 292/56; Y10S 292/73; E05B 17/0045; E05B 77/36
(Continued)

(56) References Cited

U.S. PATENT DOCUMENTS 2,029,711 A * 2/1936 Frantz ..... E05F 5/06 16/82
3,153,553 A * 10/1964 Sandor ..... E05B 85/14 292/336.3
(Continued)

FOREIGN PATENT DOCUMENTS

DE 4125184 A1 * 2/1993 ..... B60J 3/0213
EP 1099816 A1 * 5/2001 ..... E05B 85/10
(Continued)

OTHER PUBLICATIONS

Extended European Search Report dated Dec. 8, 2015 in Patent Application 15178957.5.
(Continued)

*Primary Examiner* — Carlos Lugo
(74) *Attorney, Agent, or Firm* — Oblon, McClelland, Maier & Neustadt, L.L.P.

(57) ABSTRACT

A door handle device for a vehicle includes a frame member, an outside handle and a seal member. The frame member includes a frame-side stopper. The outside handle includes a handle shaft portion and an engagement leg portion. The handle shaft portion is mounted to the frame member. The seal member includes a body portion sealing the outside handle and the door outer panel, the seal member including an extending portion extending from the body portion to a first region where the frame-side stopper and the handle-side stopper face with each other. The extending portion includes a first buffer piece. The frame-side stopper receives an impact generated in response to a pivot of the outside handle about the handle shaft portion to the full stroke position via the first buffer piece of the extending portion of the seal member, the first buffer piece being positioned at the first region.

4 Claims, 8 Drawing Sheets

(51) Int. Cl.

| | |
|---|---|
| ***E05B 77/34*** | (2014.01) |
| ***E05B 77/36*** | (2014.01) |
| ***E05B 79/06*** | (2014.01) |
| *E05B 1/00* | (2006.01) |
| *E05B 17/00* | (2006.01) |

(52) U.S. Cl.
CPC ..... *E05B 17/0045* (2013.01); *Y10S 292/56* (2013.01); *Y10S 292/73* (2013.01)

(58) Field of Classification Search
USPC ..... 292/336.3
See application file for complete search history.

(56) References Cited

U.S. PATENT DOCUMENTS

| | | | | | |
|---|---|---|---|---|---|
| 4,482,179 | A * | 11/1984 | Johnson | E05B 1/0038 | 292/336.3 |
| 5,862,570 | A * | 1/1999 | Lezuch | E05C 17/085 | 16/82 |
| 6,234,041 | B1 * | 5/2001 | Larabet | E05B 85/16 | 74/523 |
| 6,363,577 | B1 * | 4/2002 | Spitzley | E05B 79/06 | 16/438 |
| 7,677,614 | B2 * | 3/2010 | Monig | E05B 85/16 | 292/336.3 |
| 7,866,714 | B2 * | 1/2011 | Monig | E05B 81/76 | 292/336.3 |
| 8,328,250 | B2 * | 12/2012 | Botten | E05B 79/06 | 277/644 |
| 8,991,880 | B2 * | 3/2015 | Yokoyama | E05B 85/10 | 292/336.3 |
| 9,404,293 | B2 * | 8/2016 | Kudoh | E05B 77/38 | |
| 2002/0089194 | A1 * | 7/2002 | Nomura | E05B 85/16 | 292/336.3 |
| 2004/0217602 | A1 | 11/2004 | Nomura et al. | | |
| 2007/0182107 | A1 | 8/2007 | Wesson et al. | | |
| 2014/0049058 | A1 | 2/2014 | Kudoh et al. | | |

FOREIGN PATENT DOCUMENTS

| | | | |
|---|---|---|---|
| EP | 2 700 772 | A1 | 2/2014 |
| JP | 2004-92250 | A | 3/2004 |
| JP | 2005-76367 | | 3/2005 |
| JP | 2007032257 | A * | 2/2007 |
| JP | 2008-248496 | A | 10/2008 |
| JP | 2012-225116 | A | 11/2012 |

OTHER PUBLICATIONS

Office Action dated Mar. 20, 2018 in Japanese Patent Application No. 2014-154591 (with English language translation), 7 pages.

* cited by examiner

DOOR HANDLE DEVICE FOR VEHICLE

CROSS REFERENCE TO RELATED APPLICATIONS

This application is based on and claims priority under 35 U.S.C. § 119 to Japanese Patent Application 2014-154591 filed on Jul. 30, 2014, the entire content of which is incorporated herein by reference.

TECHNICAL FIELD

This disclosure generally relates to a door handle device for a vehicle.

BACKGROUND DISCUSSION

An example of a known door handle device being mounted to a vehicle door (hereinafter referred to as a door handle device) is disclosed in JP2005-76367A (hereinafter referred to as Patent reference 1). According to Patent reference 1, the door handle device includes a structure for reducing a hit noise that is generated in response to the return of an inside door handle from a full stroke position (a door-opening position) where the inside handle is pulled to open the door to an initial position. Even when the inside handle pivots to the full stroke position, the hit noise may be reduced without deteriorating an appearance. The structure is configured by a dedicated buffer member that is applied to the inside handle.

According to the door handle device disclosed in Patent reference 1, the impact is generated because a handle-side stopper and a frame-side stopper directly contact with each other when the handle is pulled from an initial position to the full stroke position. In a case where the handle-side stopper and the frame-side stopper are made from a material having a strength and a stiffness in order for the handle not to be separated from a frame member, the impact further increases. As a result, a large hit noise may be generated or an operation feeling of the handle may be degraded. Specifically, in a case where the door handle device is provided with an outside handle including the frame member that is mounted to a metal-made door outer panel and the handle being positioned outside the door outer panel, the impact generated in response to the movement of the outside handle to the full stroke position or to the initial position travels from the outside handle to the metal-made door outer panel via the frame member. Accordingly, the hit noise may be amplified and resounded. Here, such a door handle device is desired to include a structure that prevents the impact from generating in response to the pulling of the outside handle from the initial position to the full stroke position. In addition, in this case, a low-cost, easy-to-use structure without increasing a number of components is desired to be used. However, the door handle device disclosed in Patent reference 1 includes the structure that reduces only the hit noise generated in response to the return of the inside handle from the full stroke position to the initial position. Further, because the door handle device disclosed in Patent reference 1 includes the dedicated buffer member, the structure of the door handle device disclosed in Patent reference 1 cannot be established with the low-cost, easy-to-use structure.

A need thus exists for a door handle device for a vehicle which is not susceptible to the drawback mentioned above.

SUMMARY

According to an aspect of this disclosure, a door handle device for a vehicle includes a frame member configured to be mounted to a door outer panel from an inner side of the vehicle, the door outer panel configuring an outer surface of a vehicle door, an outside handle being formed in an elongated shape, the outside handle including a first end and a second end, and a seal member being made from an elastic material. The frame member includes a frame-side stopper. The outside handle includes a handle shaft portion being provided at a portion positioned at the first end, the handle shaft portion serving as a pivot center of the outside handle, the outside handle including an engagement leg portion being provided at a portion positioned at the second end, the engagement leg portion including a handle-side stopper. The handle shaft portion is mounted to the frame member via a first opening portion being formed at the door outer panel. The engagement leg portion is mounted to the frame member via a second opening portion being formed at the door outer panel, the outside handle pivoting about the handle shaft portion between an initial position and a full stroke position, the outside handle being prevented from pivoting in a direction opposite to the initial position by an engagement of the handle-side stopper and the frame-side stopper of the frame member in a case where the outside handle is positioned at the full stroke position. The seal member includes a body portion being configured to be provided at the opening portion of the door outer panel, the body portion sealing the outside handle and the door outer panel, the seal member including an extending portion extending from the body portion to a first region, the first region where the frame-side stopper and the handle-side stopper face with each other. The extending portion includes a first buffer piece. The frame-side stopper receives an impact generated in response to a pivot of the outside handle about the handle shaft portion to the full stroke position via the first buffer piece of the extending portion of the seal member, the first buffer piece being positioned at the first region.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
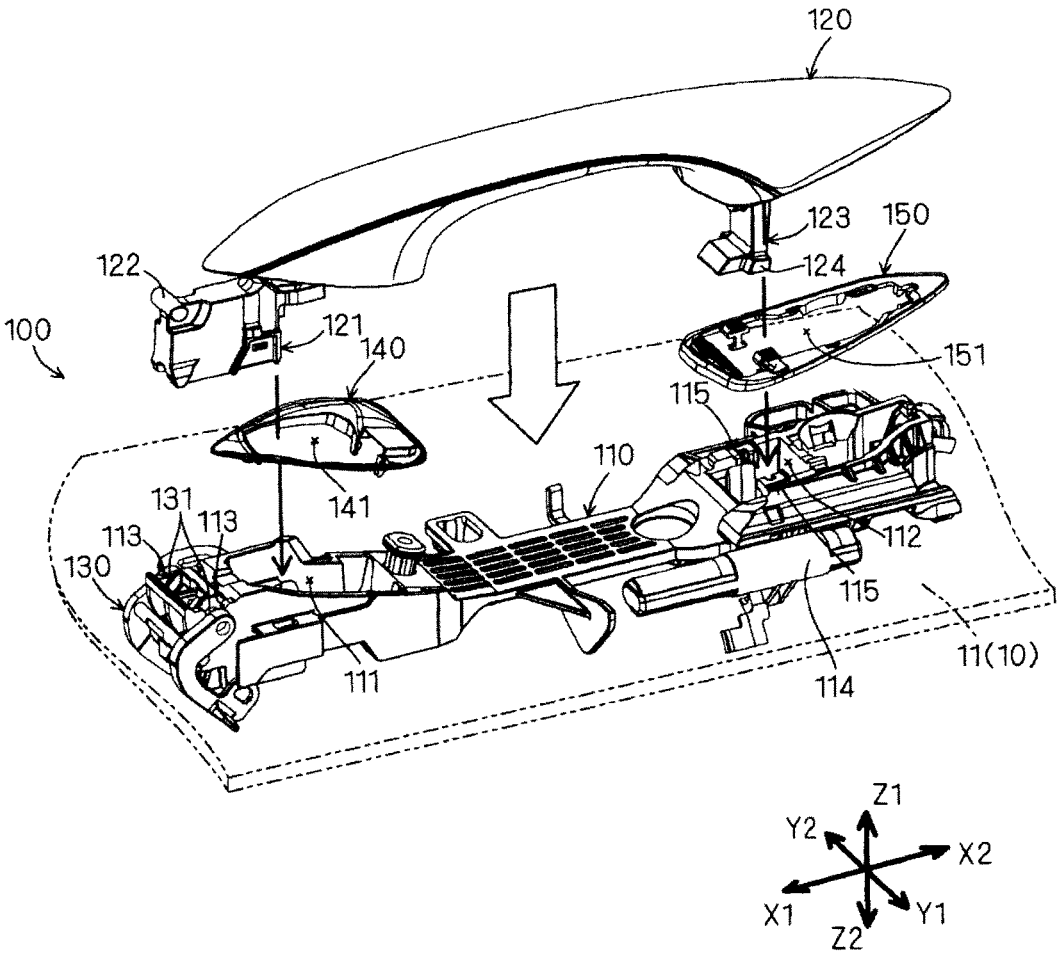
FIG. 1 is an exploded perspective view illustrating a construction of a door handle device for a vehicle according to an embodiment disclosed here.

An embodiment of this disclosure will hereunder be explained with reference to the drawings. In the drawings, arrows X1 and X2 show a frontward direction and a rearward direction of a vehicle, respectively. Allows Y1, Y2 show an upward direction and a downward direction of the vehicle, respectively. Arrows Z1, Z2 show an outward direction and an inward direction of the vehicle, respectively. A door handle device 100 for a vehicle that is before being mounted to a vehicle door or after being mounted to the vehicle door may be shown with the aforementioned directions.

As shown in FIG. 1, the door handle device 100 for the vehicle (hereinafter referred to as the door handle device) of the embodiment is mounted to a vehicle door 10, in particular, to a door outer panel 11 that configures the vehicle door 10. The door outer panel 11 is a door panel that is made of metal and that configures an outer surface of the vehicle door 10. The door handle device 100 is configured as an assembly (also referred to as an assy) that is integrally assembled with plural components. The plural components correspond to a frame member 110, an outside handle 120, a bearing member 130, a first seal member 140 and a second seal member 150 (i.e., serving as a seal member).

The frame member 110 is a member that extends laterally along the vehicle frontward-rearward directions X1, X2. The frame member 110 is mounted to the door outer panel 11 of the vehicle door 10 from an inner side of the vehicle. The frame member 10 holds the outside handle 120 by being engaged with the outside handle 120. The frame member 110 corresponds to a frame member of this disclosure. A front end portion of the frame member 110 is provided with a first opening portion 111. A rear end portion of portion of the frame member 110 is provided with a second opening portion 112. Engagement portions of the outside handle 120 for the engagement with the frame member 110 protrude from an outer side of the vehicle to the inner side of the vehicle via a through hole 141 of the first seal member 140, a through hole 151 of the second seal member 150, an opening portion of the door outer panel 11 and the first and second opening portions 111,112 of the frame member 110.

A support opening 113 provided at the first opening portion 111 of the frame member 110 is formed at each of a pair of frame wall portions that are positioned away from each other in the vehicle upward-downward directions Y1, Y2. The support openings 113, 113 are configured as bearings that pivotally support a pair of support shaft portions 131, 131 of the bearing member 130, respectively. In this case, the support openings 113 open outwardly of the vehicle. The support opening 113 includes an opening width that corresponds to a shaft diameter of the support shaft portion 131. Thus, the bearing member 130 is set at a position to prepare for being mounted to the frame member 110 by fitting the support shaft portion 131 of the bearing member 130 into the support openings 113 of the frame member 110 from the outer side of the vehicle (an upper portion in FIG. 1). Then, the bearing member 130 is set at a position for being mounted to the frame member 110 by pivoting about the support shaft portion 131 while the bearing member 130 is supported with the frame member 110 at the support opening 113. Frame-side stoppers 115, 115 are provided at respective inner wall surfaces of the pair of frame wall portions that are spaced away from each other in the vehicle upward-downward directions Y1, Y2 at the second opening portion 112 of the frame member 110. The frame-side stopper 115 serves as a frame-side stopper of this disclosure.

The outside handle 120 is configured as a grip-type handle portion (also referred to as an outside handle), and similarly to the frame member 110, the outside handle 120 extends in the lateral direction along the vehicle frontward-rearward directions X1, X2 and includes a first end and a second end. An operator holds the outside handle 12 and opens/closes the vehicle door 10. The outside handle 120 serves as an outside handle of this disclosure.

A front end portion (a first end portion) of the outside handle 120 includes an engagement arm 121 that is positioned in the first opening portion 111 of the frame member 110. The engagement arm 121 includes a cylindrical handle shaft portion 122 that extends in the vehicle upward-downward directions Y1, Y2 when mounted to the vehicle and is pivotally mounted to the bearing member 130 about the handle shaft portion 122. That is, the handle shaft portion 122 that is provided at the first end portion of the outside handle 120 serves as a pivot center of the outside handle 120. Thus, in a state where the bearing member 130 is integrally mounted to the frame member 110, the outside handle 120 is pivotable about the handle shaft portion 122 in the vehicle outward and inward directions Z1, Z2 between the initial position and the full stroke position.

Figure 2:
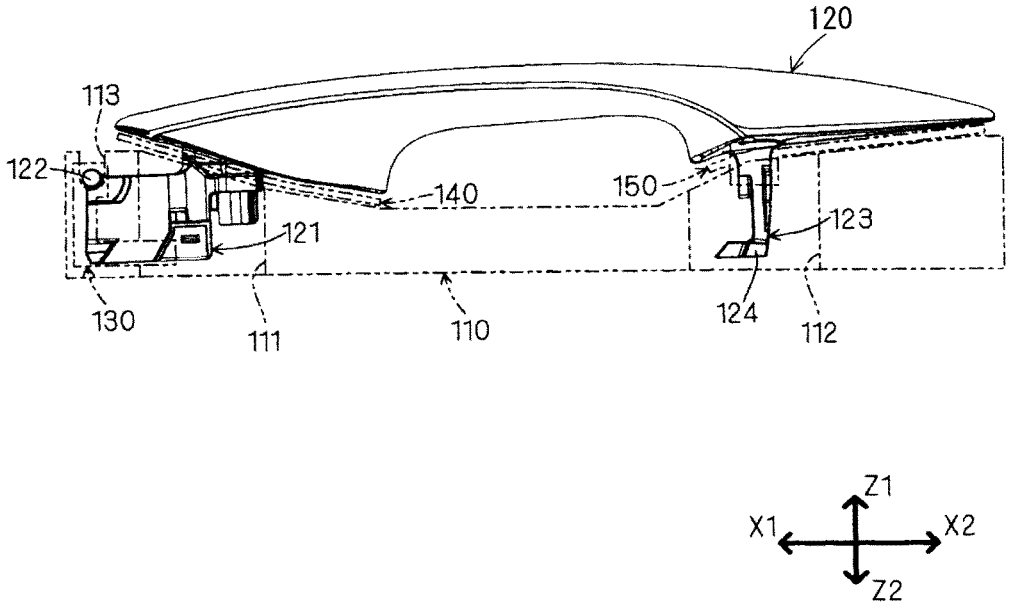
FIG. 2 is a side view of the door handle device for the vehicle in a state where an outside door handle is disposed at an initial position.
Figure 3:
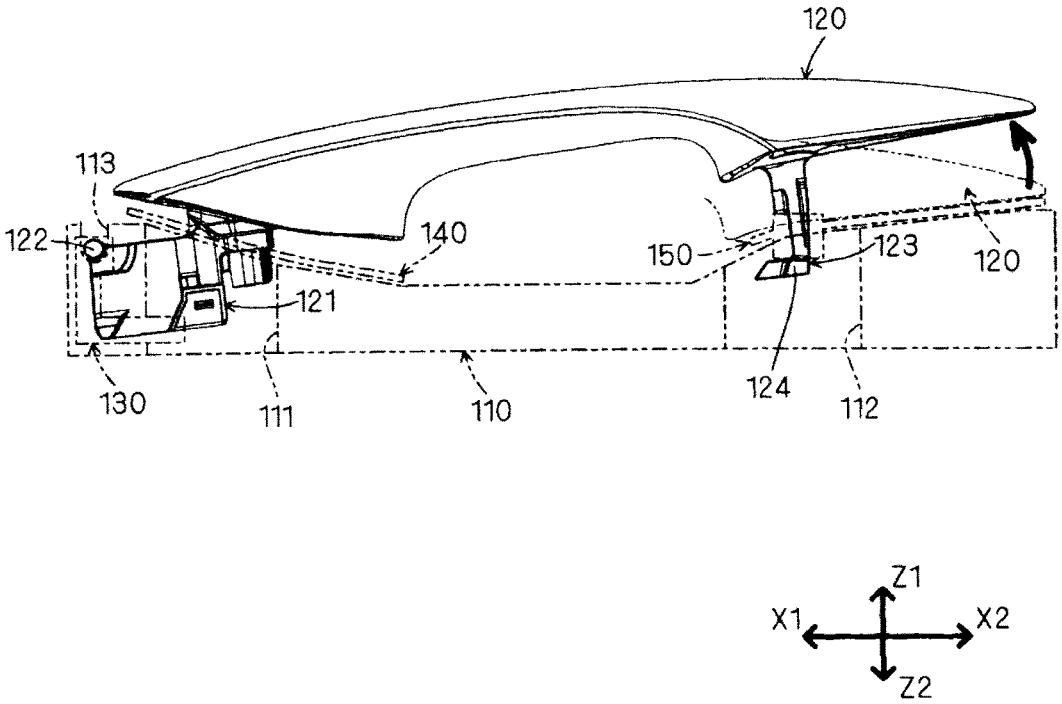
FIG. 3 is a side view of the door handle device for the vehicle in a state where the outside door handle is disposed at a full stroke position.

A rear end portion (a second end portion) of the outside handle 120 includes an engagement leg portion 123 that is positioned in the second opening portion 112 of the frame member 110. The engagement leg portion 123 has a substantially L-shaped cross section and extends toward the frame member 110. The engagement leg portion 123 is engaged with a lever member 114 (counterweight) that is pivotally supported at the frame member 110. The lever member 114 is connected to a coil spring for pulling the engagement leg portion 123 in the inward direction Z2 of the vehicle. The lever member 114 is connected to a door lock mechanism via a connection rod. Accordingly, in a case where the outside handle 120 pivots about the handle shaft portion 122 from the initial position shown in FIG. 2 to the full stroke position shown in FIG. 3, the door lock mechanism switches from a locked state to an unlocked state because the engagement leg portion 123 moves in the vehicle outward direction Z1 against an elastic biasing force of the coil spring. An extending end region of the engagement leg portion 123 (provided at the second end portion of the outside handle 120) includes a set of handle-side stoppers 124, 124. When the outside handle 120 pivots about the handle shaft portion 122 to the full stroke position shown in FIG. 3, the handle-side stoppers 124 prevent a further pivot (a pivot in a direction opposite to the initial position shown in FIG. 2) of the outside handle 120 by being engaged with the frame-side stoppers 115 of the frame member 110. When the outside handle 120 pivots to the full stroke position, the frame-side stoppers 115 and the handle-side stoppers 124 are engaged with each other to be in contact with each other indirectly while sandwiching a portion of the second seal member 150 between the frame-side stoppers 115 and the handle-side stopper 124. The handle-side stopper 124 serves as a handle-side stopper of this disclosure.

As above, the handle shaft portion 122 and the engagement leg portion 123 of the outside handle 120 are mounted to the frame member 110 from the outer side of the door outer panel 11 via the first and second opening portions 111, 112 provided at the outer panel 11. The handle shaft portion 122 and the engagement leg portion 123 serve as a handle shaft portion and an engagement leg portion, respectively, of this disclosure.

The first seal member 140 is a plate-shaped member that is positioned between the front end portion of the outside handle 120 and the door outer panel 11. The second seal member 150 is a plate-shaped member that is positioned between the rear end portion of the outside handle 120 and the door outer panel 11. Each of the first and second seal members 140, 150 is made from an elastic material, for example, a synthetic resin or a rubber. The first and second seal members 140, 150 serve as gap sealing functions, or gap sealing portions that seal gaps formed between the outside handle 120 and the door outer panel 11. Thus, for example, liquid or air is prevented from entering into the inner side of the vehicle relative to the outer panel 11.

When a known outside handle is pulled from the initial position to the full stroke position (a door-opening position) or when the known outside handle returns from the full stroke position to the initial position, a large impact is generated because the outside handle directly comes in contact with a frame member. As a result, a large hit noise may be generated or the operation feeling of the outside handle may be degraded. In order for the outside handle not to be separated from the frame member, the outside handle including a handle-side stopper and the frame member including a frame-side stopper are made from materials that have high strength and stiffness, that is, the known outside handle including the handle-side stopper and the frame member including the frame-side stopper are typically made from a hard resin material. Thus, the generation of the hit noise or the degradation of the operation feeling may occur significantly. Further, because an impact generated in response to the movement of the outside handle to the full stroke position or to the initial position is delivered from the outside handle to a metal-made door outer panel via the frame member, the hit noise may be amplified and echoed or resounded.

Figure 4:
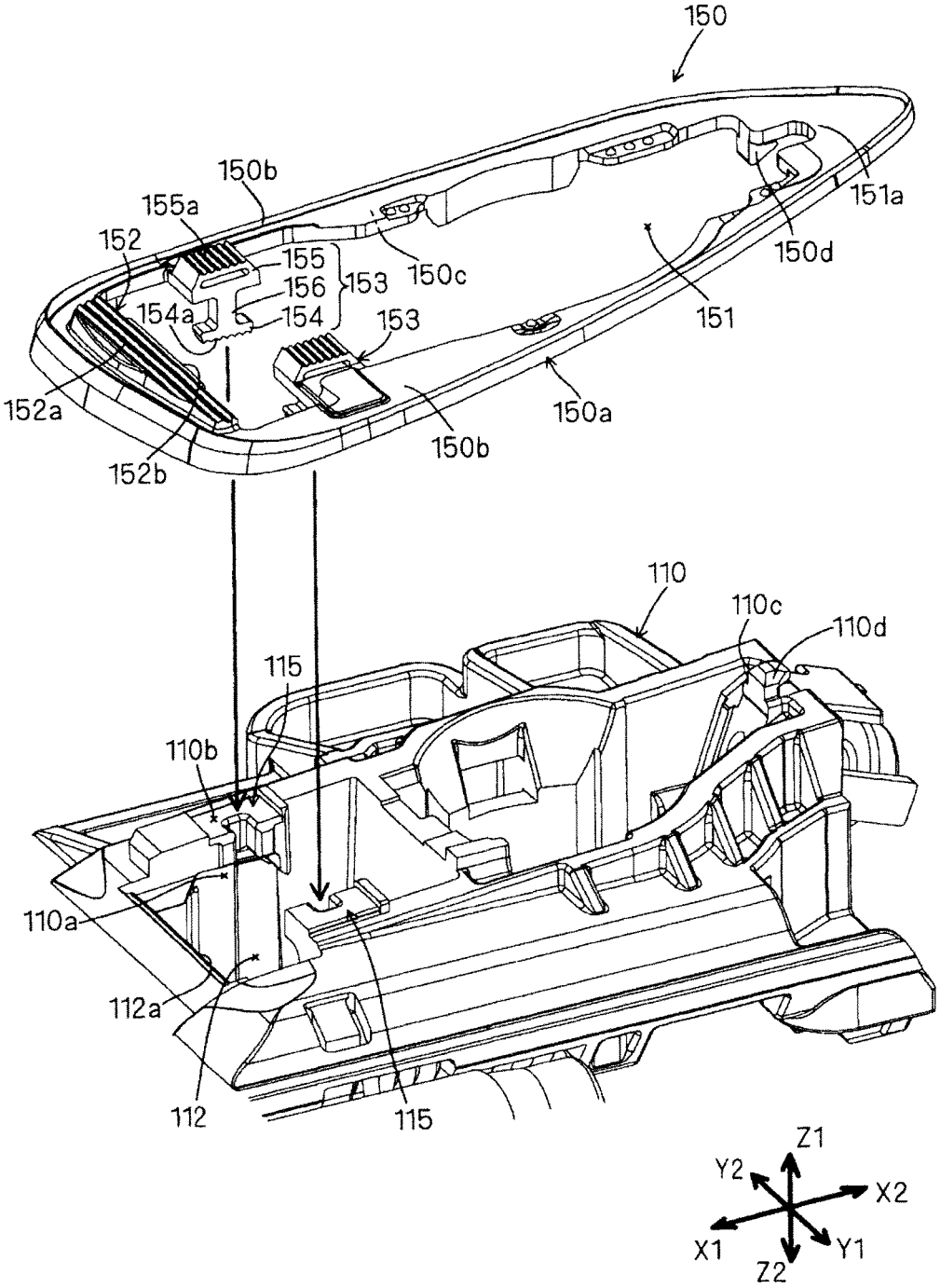
FIG. 4 is a perspective view of a seal member shown in FIG. 1.

However, according to the embodiment of this disclosure, in addition to the gap sealing function, or the gap sealing portion, the second seal member 150 of the embodiment includes an impact-softening function (also referred to as a shock absorption function that absorbs the impact) that softens the impact generated in response to the movement of the outside handle 120 to the full stroke position or to the initial position. The second seal member 150 serves as a seal member of this disclosure. For this purpose, as shown in FIG. 4, the second seal member 150 includes an annular body portion 150*a*, a buffer piece 152 and a pair of (a set of) extending portions 153, 153. The body portion 150*a* is positioned at the second opening portion 112 of the frame member 110 (the opening portion of the door outer panel 11) and seals the outside handle 120 and the door outer panel 11 to serve as a gap sealing function, or a gap sealing portion. The buffer piece 152 and the pair of extending portions 153, 153 serve as the impact-softening function. The extending portions 153, 153 are positioned at a rear of the vehicle relative to the buffer piece 152. The pair of extending portions 153, 153 is positioned spaced apart from each other by a predetermined interval in the upward-downward directions Y1, Y2 of the vehicle. The body portion 150*a* and the extending portions 153, 153 serve as a body portion and extending portions, respectively, of this disclosure.

The buffer piece 152 is connectively provided with an opening rim of a front end of the body portion 150*a*. The buffer piece 152 includes an engagement surface 152*a* that protrudes in the vehicle outward direction Z1 relative to an outer surface 150*b* of the body portion 150*a*. When the outside handle 120 returns from the full stroke position to the initial position, the buffer piece 152 intervened between the frame member 110 and the outside handle 120 serves as a function that softens or absorbs the impact generated at the engagement surface 152*a*.

Figure 5:
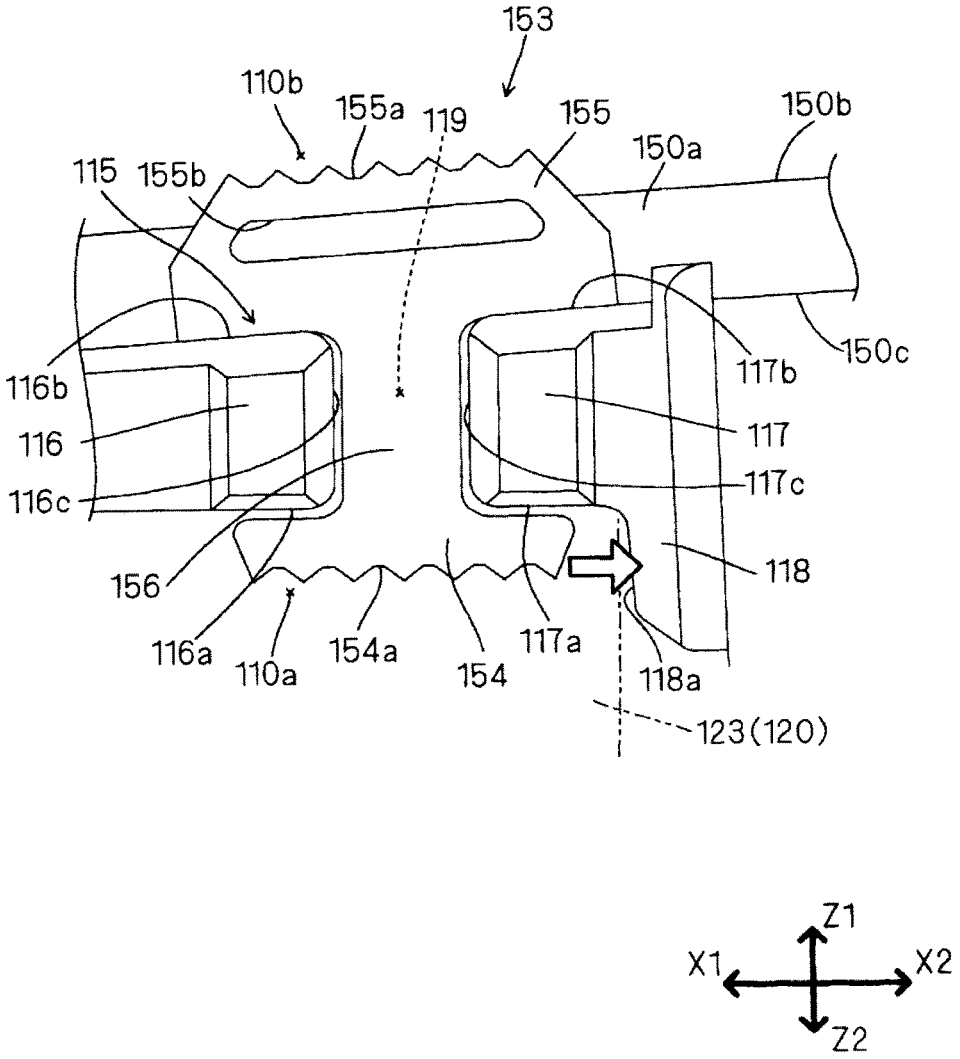
FIG. 5 is a view illustrating a state where an extending portion of the seal member shown in FIG. 4 is mounted to a frame member.

As shown in FIGS. 4 and 5, the extending portions 153, 153 are connectively provided at an opening rim of a rear of the body portion 150*a* relative to the buffer piece 152. The extending portion 153 extends from the body portion 150*a* to a first region 110*a* where the frame-side stopper 115 and the handle-side stopper 124 face with each other (see FIG. 7). The extending portion 153 is provided with a first buffer piece 154 and a second buffer piece 155 that are spaced apart from each other in the vehicle inward-outward directions Z2, Z1 and that extend in parallel with each other along the vehicle frontward-rearward directions X1, X2 (the extending directions of the outside handle 120). The first and second buffer pieces 154, 155 are connected with each other via a connection piece 156. The connection piece 156 has the length in the vehicle frontward-rearward directions X1, X2, the length shorter than the respective lengths of the of the first and second buffer pieces 154, 155 in the vehicle frontward-rearward directions X1, X2. That is, the extending portion 153 is formed in a substantially capital I shape or a substantially lateral-H shape when seen from the vehicle upward direction Y1 or from the vehicle downward direction Y2. The first buffer piece 154, the second buffer piece 155 and the connection piece 156 serve as a first buffer piece, a second buffer piece and a connection piece, respectively, of this disclosure.

The first buffer piece 154 protrudes in the vehicle inward direction Z2 relative to an inner surface 150*c* of the body portion 150*a* to be positioned at the first region 110*a*. A protruding end portion of the first buffer piece 154 includes a first engagement surface 154*a*. The second buffer piece 155 protrudes in the vehicle outward direction Z1 relative to an outer surface 150*b* of the body portion 150*a* to be positioned at a second region 110*b* that is positioned opposite to the first buffer piece 154. The first buffer piece 154 and the second buffer piece 155 sandwich the frame-side stopper 115 therebetween. A protruding end portion of the second buffer piece 155 includes a second engagement surface 155*a*. In this case, when the outside handle 120 is pulled from the initial position to the full stroke position, the first buffer piece 154 is intervened between the frame-side stopper 115 of the frame member 110 and the handle-side stopper 124 of the outside handle 120 to soften or absorb the impact generated at the first engagement surface 154*a*. On the other hand, when the outside handle 120 returns from the full stroke position to the initial position, the second buffer piece 155 is intervened between the frame-side stopper 115 of the frame member 110 and the outside handle 120 to soften or absorb the impact generated at the second engagement surface 155*a*.

Meanwhile, each of the engagement surface 152*a* of the buffer piece 152, the first engagement surface 154*a* of the first buffer piece 154, and the engagement portion 155*a* of the second buffer piece 155 may favorably include a protrusion-recess structure that plural pairs of protrusions and recesses are disposed continuously in a predetermined direction (for example, in the vehicle frontward-rearward directions X1, X2). According to the protrusion-recess structure, the volume and the weight of the extending portion 153 may be reduced while maintaining the thickness of the buffer piece to secure a desired impact-softening performance.

The impact generated by the contact of the outside handle 120 to the frame member 110 in response to the movement of the outside handle 120 to the full stroke position or to the initial position is generally larger when the outside handle 120 returns to the initial position than when the outside handle 120 is pulled to the full stroke position. According to the extending portion 153 of the embodiment, the second buffer piece 155 is favorably larger than the first buffer piece 154. The gross area of the second engagement surface 155*a* coming in contact with the outside handle 120 is favorably larger than the gross area of the first engagement surface 154*a* coming in contact with the outside handle 120. The second buffer piece 155 of the extending portion 153 favorably includes a hollow portion 155*b* for softening the impact (for enhancing cushioning properties against the impact) generated in response to the return of the outside handle 120 to the initial position. Thus, a large impact generated in response to the return of the outside handle 120 to the initial position may be effectively softened.

Figure 6:
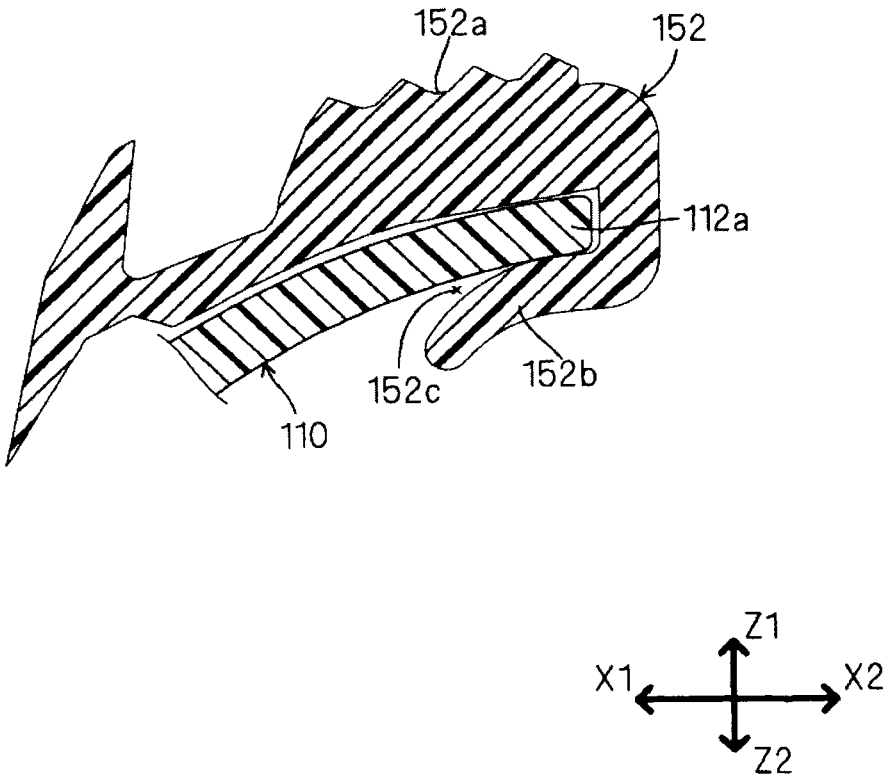
FIG. 6 is a cross sectional view illustrating a state where a buffer piece of the seal member shown in FIG. 4 is mounted to the frame member.

The second seal member 150 is provided with plural engagement portions for being mounted to the frame member 110. As shown in FIG. 4, the plural engagement portions include a rear engagement pawl 150*d*, an opening rim portion 151*a* of the through hole 151, and a front engagement pawl 152*b*. The rear engagement pawl 150*d* extends from the body portion 150*a*. The front engagement pawl 152*b* extends from the buffer piece 152. The rear engagement pawl 150*d* engages with the engagement recessed portion 110*c* of the frame member 110. The opening rim portion 151*a* is hooked with an engagement pawl 110*d* of the frame member 110. As shown in FIG. 6, the front engagement pawl 152*b* extends along the vehicle frontward direction X1 after extending to the vehicle inward direction Z2 to include an engagement recessed portion 152*c*. An opening rim 112*a* of the second opening portion 112 of the frame member 110 is engaged with, or positioned in the engagement recessed portion 152*c*.

Meanwhile, the frame-side stopper 115 of the frame member 110 includes an engagement structure that engages the frame-side stopper 115 with the extending portion 153 for positioning the frame member 110 to the second seal member 150. As shown in FIG. 5, the engagement structure is configured by a first engagement protrusion 116 and a second engagement protrusion 117 that are spaced apart from each other in the vehicle frontward-rearward directions X1, X2 while having the engagement groove 119 therebetween. The first and second engagement protrusions 116, 117 are sandwiched by the first and second buffer pieces 154, 155 in the vehicle outward-inward directions Z1, Z2. The first and second engagement protrusions 116, 117 are configured as protruding ribs that extend from inner wall surfaces of the frame member 110 in the vehicle upward direction Y1 or in the vehicle downward direction Y2. According to the engagement structure, the second seal member 150 may be positioned easily relative to the frame member 110. In this case, because the second seal member 150 is positioned at a position relative to the frame member 110 that is integrally mounted with the outside handle 120, the relative positions of the frame member 110, the outside handle 120 and the second seal member 150 may be defined accurately.

According to the engagement structure, a first engagement wall 116*a* of the first engagement protrusion 116 and a second engagement wall 117*a* of the second engagement protrusion 117 are positioned opposite to the first buffer piece 154 in a state where the frame-side stopper 115 is engaged with the extending portion 153 (in a state where the connection piece 156 is fitted in the engagement groove 119). In this engagement state, a third engagement wall 116*b* of the first engagement protrusion 116 and a fourth engagement wall 117*b* of the second engagement protrusion 117 are positioned to face the second buffer piece 155. The first engagement protrusion 116 includes a fifth engagement wall 116*c* that extends from the first engagement wall 116*a* to the third engagement wall 116*b*. The second engagement protrusion 117 includes a sixth engagement wall 117*c* that extends from the second engagement wall 117*a* to the fourth engagement wall 117*b*. The engagement groove 119 is defined by the fifth and sixth engagement walls 116*c*, 117*c*.

The groove width of the engagement groove 119 in the vehicle frontward-rearward directions X1, X2 substantially matches the thickness of the connection piece 156 in the vehicle frontward-rearward directions X1, X2. The groove length of the engagement groove 119 in the vehicle outward-inward directions Z1, Z2 (the distance between the first engagement wall 116*a* and the third engagement wall 116*b* or the distance between the second engagement wall 117*a* and the fourth engagement wall 117*b*) substantially matches the length of the connection piece 156 in the vehicle outward-inward direction Z1, Z2. Accordingly, the extending portion 153 is securely engaged with the frame-side stopper 115. Further, because only the connection piece 156 is used for connecting the first buffer piece 154 to second buffer piece 155, a space desired for the connection of the buffer pieces may be small. Alternatively, the first and second buffer pieces 154, 155 may be connected with each other via plural connecting pieces if required.

According to the engagement structure, the first and third engagement walls 116*a*, 117*a* are in contact with the first buffer piece 154 and are against the load applied to the extending portion 153 in the vehicle outward direction Z1. The second and fourth engagement walls 116*b*, 117*b* are in contact with the second buffer piece 155 and are against the load applied to the extending portion 153 in the vehicle inward direction Z2. The fifth and sixth engagement walls 116*c*, 117*c* are in contact with the connection piece 156 and are against the load applied to the extending portion 153 in the vehicle frontward-rearward directions X1, X2. That is, in a state where the connection piece 156 of the extending portion 153 is engaged with the engagement groove 119, the extending portion 153 can be prevented from being released from the engagement groove 119 because the first and second engagement protrusions 116, 117 prevent the extending portion 153 from moving in the vehicle frontward-rearward directions X1, X2 (the extending directions of the first and second buffer pieces 154, 155) and in the vehicle outward-inward directions Z1, Z2 (the extending directions of the connection piece 156).

According to the frame-side stopper 115 being configured by the first and second engagement protrusions 116, 117 that are spaced apart from each other while having the engagement groove 119 therebetween, the frame-side stopper 115 favorably maintains a desired strength or stiffness without increasing the length of the frame-side stopper 115 in the vehicle frontward-rearward directions X1, X2 and in the vehicle outward-inward directions Z1, Z2. Thus, according to the frame-side stopper 115 of the embodiment, the second engagement protrusion 117 of the first and second engagement protrusions 116, 117, the second engagement protrusion 117 that is positioned at the rear of the vehicle relative to the first engagement protrusion 116, is provided with a reinforcement rib 118. The reinforcement rib 118 extends from a portion (engagement wall 117*a*) that receives the impact generated in response to the pivot of the outside handle 120 about the handle shaft portion 122 to the full stroke position in the inward direction Z2 of the vehicle along a direction of action of the impact. The reinforcement rib 118 serves as a reinforcement rib of this disclosure. According to the reinforcement rib 118, the door handle device 100 is prevented from upsizing because the frame-side stopper 115 that is configured by the first and second engagement protrusions 116, 117 does not have to upsize for securing a desired strength or stiffness.

The reinforcement rib 118 of the second engagement protrusion 117 is favorably provided with a load sustaining surface 118*a*. When the load is applied to the outside handle 120 in the vehicle rearward direction X2 along the extending direction of the outside handle 120, the load sustaining surface 118*a* comes in contact with the engagement leg portion 123 being biased in the vehicle rearward direction X2 and receives a load applied from the engagement leg portion 123. The load sustaining surface 118*a* serves as a load sustaining surface of this disclosure. The action of the load relative to the outside handle 120 is generated in response to the normal opening and normal closing of a door by an operator who holds the outside handle 120. Thus, the reinforcement rib 118 prevents the outside handle 120 from moving in the direction of the load.

Figure 7:
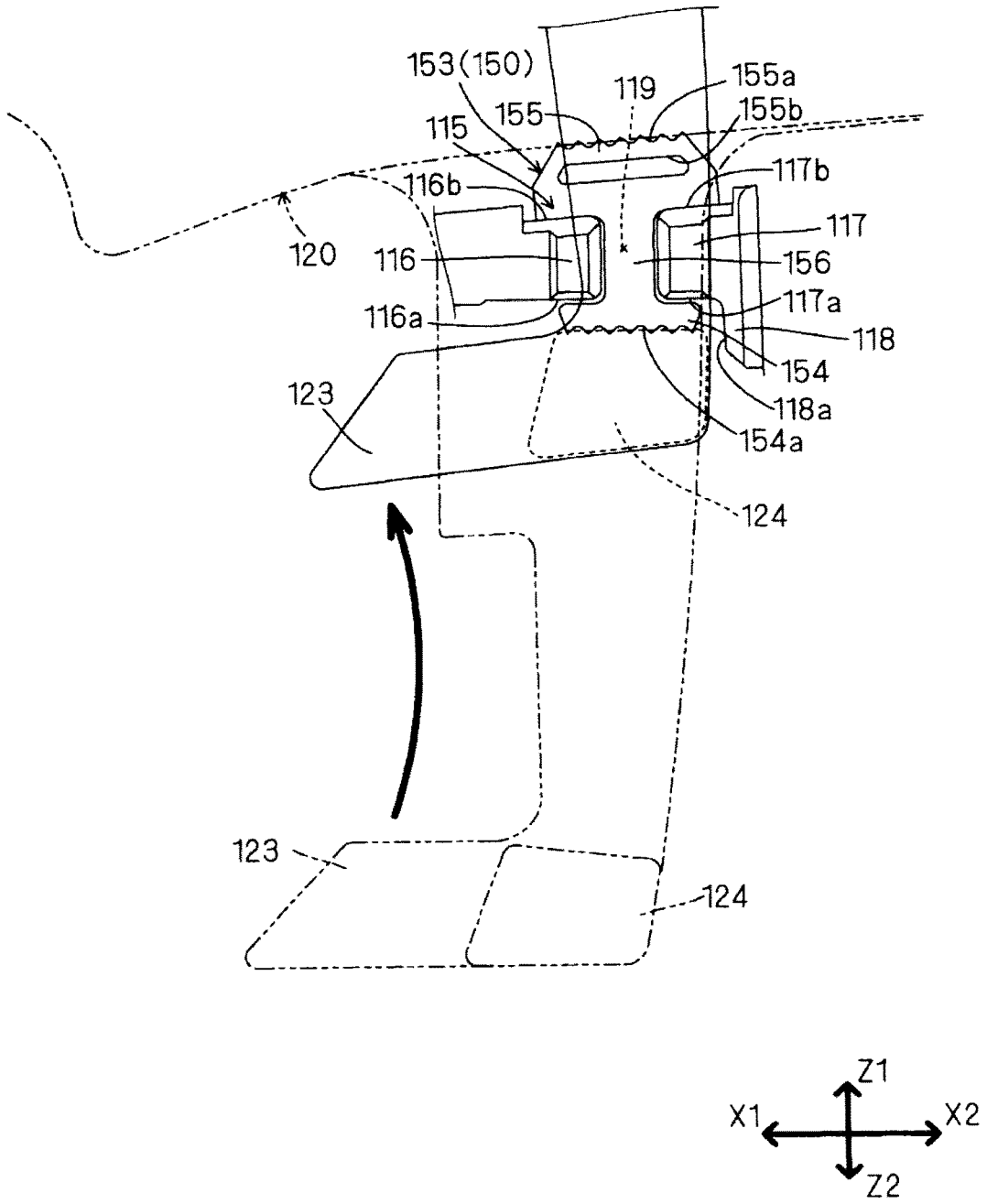
FIG. 7 is an explanatory view of a movement of the outside handle that is pulled from the initial position to the full stroke position.

According to the aforementioned embodiment, following effects and advantages of the extending portion 153 may be attained. As shown in FIG. 7, when the outside handle 120 is pulled from the initial position to the full stroke position, the handle-side stopper 124 of the engagement leg portion 123 comes in contact with the first buffer piece 154 of the extending portion 153 of the second seal member 150 after pivoting in a direction of an arrow in FIG. 7. Meanwhile, the first and third engagement walls 116*a*, 117*a* of the frame-side stopper 115 (the first and second engagement protrusions 116, 117) of the frame member 10 are in contact with the first buffer piece 154 and are against the load applied from the handle-side stopper 124 to the first buffer pieces 154, 154. At this time, because the handle-side stopper 124 presses the engagement surface 154*a* of the first buffer piece 154, the first buffer piece 154 is elastically deformed to be pressurized in the outward direction Z1 of the vehicle. Finally, the further pivot (pivot in the direction opposite to the initial position) from the full stroke position of the handle-side stopper 124 is indirectly prevented by the frame-side stopper 115. That is, because the handle-side stopper 124 engages with the frame-side stopper 115 to indirectly contact with the frame-side stopper 115 while the handle-side stopper 124 and the frame-side stopper 124 sandwich the first buffer piece 154 therebetween, the outside handle 120 that is in the full stroke position cannot pivot further.

In this case, the elastic first buffer pieces 154, 154 are positioned between the set of the handle-side stoppers 124, 124 (elements positioned at the outside handle 120) that are made from a hard synthetic resin material and a set of the frame-side stoppers 115, 115 (elements positioned at the frame member 110) that are made from a hard synthetic resin material. Accordingly, the set of the frame-side stoppers 115, 115 receive the impact via the first buffer pieces 154, 154 of the second seal member 150, the impact generated in response to the pulling of the outside door handle 120 to the full stroke position. As a result, the impact is softened by the elastic first buffer pieces 154, 154. Thus, the generation of the large hit noise or the degradation of the operation feeling of the outside handle 120 may be prevented. In particular, the hit noise is prevented from being amplified and echoed or resounded, the hit noise generated because the impact is delivered from the outside handle 120 to the metal-made door outer panel 11 via the frame member 110.

Similarly to a case where the outside handle 120 is pulled to the full stroke position, in a case where the outside handle 120 returns from the full stroke position to the initial position, the elastic second buffer pieces 155, 155 are positioned between the outside handle 120 and the set of the frame-side stoppers 115, 115. Similarly to the first and second buffer pieces 154, 155, the elastic buffer piece 152 is positioned between the outside handle 120 and the set of the frame-side stopper 115, 115. Accordingly, the set of the frame-side stoppers 115, 115 receive the impact generated in response to the return of the outside handle 120 to the initial position via the three buffer pieces of the seal member 150, the three buffer pieces that are the buffer piece 152 and the second buffer pieces 155, 155. As a result, similarly to a case where the outside handle 120 is pulled to the full stroke position, the impact is softened by the elastic buffer piece 152 and the pair of the elastic extending portions 153, 153. That is, when the outside handle 120 is pulled to the full stroke position, the impact is softened by the buffer piece 152 and the first buffer pieces 154, 154. When the outside handle 120 returns from the full stroke position to the initial position, the impact is softened by the buffer piece 152 and the second buffer pieces 155, 155. Thus, the generation of the large hit sound and the degradation of the operation feeling of the outside handle 120 may be prevented. In particular, because the impact received from the outside handle 120 in response to the return of the outside handle 120 from the full stroke position to the initial position is received by three points that are the buffer piece 152 and the second buffer pieces 155, 155, the impact softening effect is enhanced.

According to the aforementioned door handle device 100, the first and second buffer pieces 154, 155 have the impact-softening function with the use of a part of the second seal member 150 having a sealing function, or a sealing portion. Accordingly, the impact softening structure may be provided without increasing the number of components. In this case, the impact generated in response to the return of the outside handle 120 to the initial position may be softened by the second buffer pieces 155, 155 while softening the impact generated in response to the pulling of the outside handle 120 to the full stroke position by the elastic first buffer pieces 154, 154. The extending portion 153 of the second seal member 150 is reasonably provided with the buffer pieces 154, 155 that soften the impact in accordance with the stroke movement of the outside handle 120 in two directions, that are, the directions to the initial position and to the full stroke position.

Figure 8:
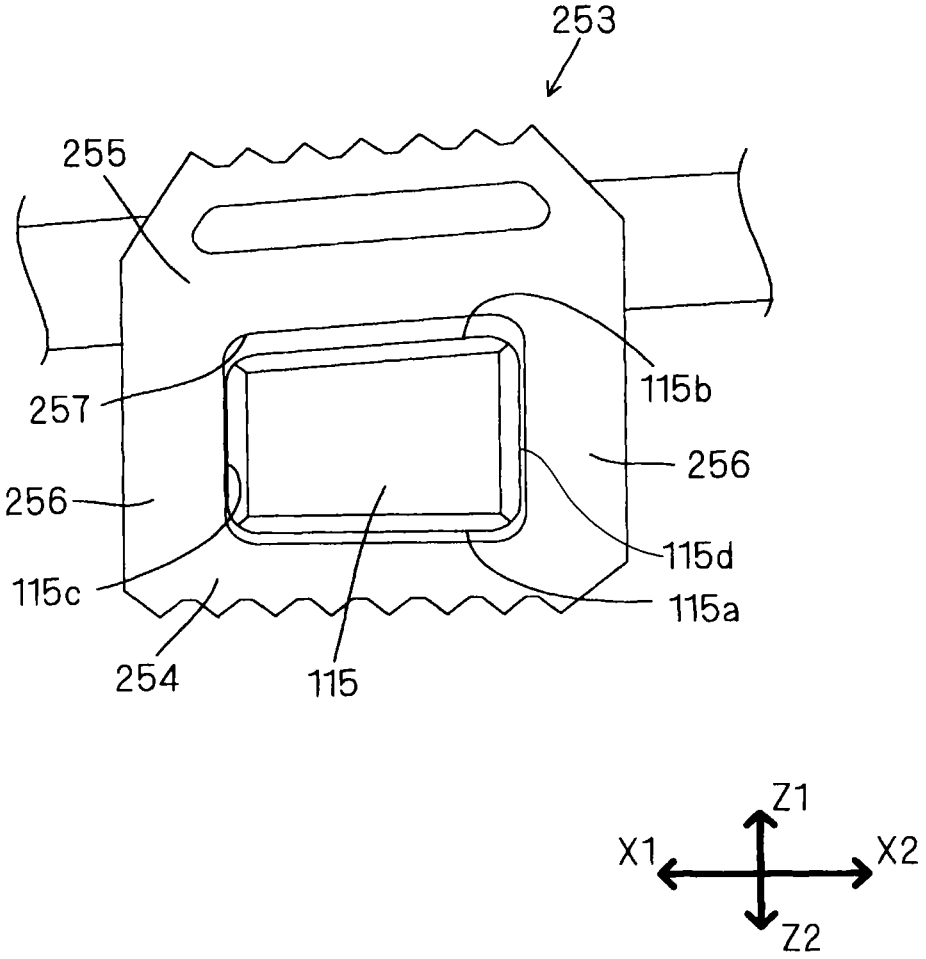
FIG. 8 is a view illustrating an extending portion of a modified example, the extending portion modified from the extending portion shown in FIG. 6.

According to another example of the extending portion 153 of the aforementioned seal member 150, an extending portion 253 having a shape shown in FIG. 8 may be provided. The extending portion 253 is provided with a first buffer piece 254 and a second buffer piece 255. The first buffer piece 254 has the same shape or substantially the same shape as the first buffer piece 154. The second buffer piece 255 has the same or substantially the same shape as the second buffer piece 155. Opposing end portions of the first and second buffer pieces 254, 255 are connected with each other via connecting pieces 256, 256, respectively. That is, the extending portion 253 is formed in a substantially hollow quadrilateral shape when seen from the vehicle upward direction Y1 or from the vehicle downward direction Y2. The extending portion 253 is engaged with the frame-side stopper 115 by the fitting of an opening portion 257 that is formed at a center region of the extending portion 253 into the frame-side stopper 115 that is formed in a protruding shape.

According to the engagement structure, a first engagement wall 115*a* and a second engagement wall 115*b* of the frame-side stopper 115 are positioned to face the first buffer piece 254 and the second buffer piece 255, respectively. A third engagement wall 115*c* and a fourth engagement wall 115*d* of the frame-side stopper 115 are positioned to face the connecting pieces 256, 256, respectively. The first engagement wall 115*a* is in contact with the first buffer piece 254 and is against the load applied to the extending portion 253 in the vehicle outward direction Z1. The second engagement wall 115*b* is in contact with the second buffer piece 255 and is against the load applied to the extending portion 253 in the vehicle inward direction Z2. The third and fourth engagement walls 115*c*, 115*d* are in contact with the connection pieces 256, 256, respectively, and are against the load applied to the extending portion 253 in the vehicle frontward-rearward directions X1, X2. Accordingly, the extending portion 253 is prevented from being released from the frame-side stopper 115 easily.

Similarly to the extending portion 153, in a case where the aforementioned extending portion 253 is used, the impact generated in response to the return of the outside handle 120 to the initial direction is softened by the elastic second buffer piece 255 while the impact generated in response to the pulling of the outside handle 120 to the full stroke position is softened by the elastic first buffer piece 254.

This disclosure is not limited to the aforementioned typical embodiment and is susceptible to various applications and modifications. For example, following examples of the embodiment are applicable.

According to the second seal member 150 of the aforementioned embodiment, the extending portion 153, 253 is provided with the first buffer piece 154, 254 for softening the impact generated in response to the pulling of the outside handle 120 to the full stroke position and the second buffer piece 155, 255 for softening the impact generated in response to the return of the outside handle 120 to the initial position. Alternatively, a part of the second seal member 150 may be used to establish the structure that at least softens the impact generated in response to the pulling of the outside handle 120 to the full stroke position. Accordingly, the extending portion 153, 253 may not include the second buffer piece 155, 255 or may exclude the impact-softening function of the second buffer piece 155, 255. The second seal member 150 may not include the buffer piece 152 or may exclude the impact-softening function of the buffer piece 152.

According to the frame member 110 of the aforementioned embodiment, one of the first and second engagement protrusions 116, 117 is provided with the reinforcement rib 118. Alternatively, at least one of the first and second engagement protrusions 116, 117 may be provided with a member that corresponds to the reinforcement rib 118. In this case, the load sustaining surface 118*a* of the reinforcement rib 118 may be separated from the reinforcement rib 118 and any member other than the reinforcement rib 118 may be used for the load sustaining function.

According to the aforementioned embodiment, the elongated outside handle 120 includes the handle shaft portion 122 that is positioned at the front end of the outside handle 120 and includes the engagement leg portion 123 that is positioned at the rear end of the outside handle 120. Alternatively, the outside handle 120 may include an element that corresponds to the engagement leg portion 123 being positioned at the front end of the outside handle 120 and may include an element that corresponds to the handle shaft portion 122 being positioned at the rear end of the outside handle 120. In this case, a seal member that includes the impact-softening function as the second seal member 150 may be applied to the engagement leg portion 123 provided at the front of the outside handle 120.

According to this disclosure, an essential structure of the door handle device 100 may be applied to any types of vehicle doors. For example, right and left doors for front seats of a vehicle, right and left doors for rear seats of the vehicle, or a rear door (a backdoor) of the vehicle may be applied with the essential structure of the door handle device 100.

According to the aforementioned embodiment, the door handle device (100) for the vehicle includes a frame member (110) configured to be mounted to the door outer panel (11) from the inner side of the vehicle, the door outer panel (11) configuring an outer surface of the vehicle door (10), the outside handle (120) being formed in an elongated shape, the outside handle (120) including the first end and the second end, and the seal member (140, 150) being made from an elastic material. The frame member (110) includes a frame-side stopper (115). The outside handle (120) includes the handle shaft portion (122) being provided at a portion positioned at the first end, the handle shaft portion (122) serving as a pivot center of the outside handle (120), the outside handle (120) including the engagement leg portion (123) being provided at a portion positioned at the second end, the engagement leg portion (123) including the handle-side stopper (124). The handle shaft portion (122) is mounted to the frame member (110) via the first opening portion (111) being formed at the door outer panel (11). The engagement leg portion (123) is mounted to the frame member (110) via the second opening portion (112) being formed at the door outer panel (11). The outside handle (120) pivots about the handle shaft portion (122) between the initial position and the full stroke position. The outside handle (120) is prevented from pivoting in a direction opposite to the initial position by the engagement of the handle-side stopper (124) and the frame-side stopper (115) of the frame member (110) in a case where the outside handle (120) is positioned at the full stroke position. The seal member (150) includes the body portion (150*a*) being configured to be provided at the opening portion (112) of the door outer panel (11), the body portion (150*a*) sealing the outside handle (120) and the door outer panel (11), the seal member (150) including an extending portion (153, 253) extending from the body portion (150*a*) to a first region (110*a*), the first region (110*a*) where the frame-side stopper (115) and the handle-side stopper (124) face with each other. The extending portion (153, 253) includes a first buffer piece (154, 254). The frame-side stopper (115) receives an impact generated in response to the pivot of the outside handle (120) about the handle shaft portion (122) to the full stroke position via the first buffer piece (154, 254) of the extending portion (153, 253) of the seal member (150), the first buffer piece (154, 254) being positioned at the first region (110*a*).

According to the aforementioned construction, the impact generated in response to the pulling of the outside handle 120 to the full stroke position may be softened by the elastic first buffer piece 154, 254. As a result, the generation of the large hit noise or the degradation of the operation feeling of the outside handle 120 may be prevented. In particular, the hit sound is prevented from being amplified and being echoed or resounded due to the travel of the impact from the outside handle 120 to the metal-made door outer panel 11 via the frame member 110. Further, the first buffer piece 154, 254 includes the impact-softening function by the use of a part of the second seal member 150 that includes the sealing function, or the sealing portion. Thus, the impact softening structure is established without increasing the number of components.

According to the aforementioned embodiment, the extending portion (153, 253) of the seal member (150) includes the second buffer piece (155, 255) being positioned at the second region (110*b*), the second region (110*b*) being positioned opposite to the first buffer piece (154, 254), while the first buffer piece (154, 254) and the second buffer piece (155, 255) sandwich the frame-side stopper (115) therebetween, the extending portion (153, 253) including at least one connection piece (156, 256) connecting the first buffer piece (154, 254) to the second buffer piece (155, 255). The frame-side stopper (115) receives an impact generated in response to the pivot of the outside handle (120) about the handle shaft portion (122) to the initial position of the outside handle (120) via the second buffer piece (154, 254) of the extending portion (153, 253) of the seal member (150).

According to the aforementioned construction, the elastic second buffer piece 155, 255 softens the impact generated in response to the return of the outside handle 120 to the initial position while the elastic first buffer piece 154, 254 softens the impact generated in response to the pulling of the outside handle 120 to the full stroke position. In this case, the extending portion 153, 253 of the second seal member 150 is reasonably provided with two buffer pieces (the first buffer piece 154, 254 and the second buffer piece 155, 255) that soften the impact in accordance with the stroke movement in two directions, that are, the directions to the initial position and to the full stroke position.

According to the aforementioned embodiment, the frame-side stopper (115) of the frame member (110) includes the engagement structure engaging the frame-side stopper (115) to the extending portion (153, 253) of the seal member (150).

According to the aforementioned engagement structure, the second seal member 150 may be easily positioned at the position relative to the frame member 110. In this case, because the second seal member 150 is positioned relative to the frame member 110 that is integrally mounted with the outside handle 120, the relative positions of the frame member 110, the outside handle 120 and the second seal member 150 may be defined accurately.

According to the aforementioned construction, the extending portion (153) of the seal member (150) includes the first buffer piece (154) and the second buffer piece (155) extending in parallel with each other along the extending direction of the outside handle (120), the first buffer piece (154) and the second buffer piece (155) being connected with each other with the connection piece (156). The engagement structure is configured by two engagement protrusions (116, 117) of the frame-side stopper (115), the engagement protrusions (116, 117) being spaced apart from each other while having the engagement groove (119) therebetween, the engagement groove (19) being engaged with the connection piece (156), the engagement protrusions (116, 117) being sandwiched by the first buffer piece (154) and the second buffer piece (155).

In this case, in a case where the connection piece 156 of the extending portion 153 is engaged with the engagement groove 119, the extending portion 153 can be prevented from being released from the engagement groove 119 because the first and second engagement protrusions 116, 117 prevent the extending portion 153 from moving in the vehicle frontward-rearward directions X1, X2 (the extending directions of the first and second buffer pieces 154, 155) and in the vehicle outward-inward directions Z1, Z2 (the extending directions of the connection piece 156).

According to the aforementioned embodiment, at least one of the engagement protrusions (116, 117) includes the reinforcement rib (118), the reinforcement rib (118) extending from a portion receiving the impact generated in response to the pivot of the outside handle (120) about the handle shaft portion (122) to the full stroke position, the reinforcement rib (118) extending from the portion along the direction of action of the impact.

According to the reinforcement rib 118, the door handle device 100 is prevented from upsizing because the frame-side stopper 115 that is configured by the first and second engagement protrusions 116, 117 does not have to upsize for securing a desired strength or stiffness.

According to the aforementioned embodiment, the reinforcement rib (118) includes the load sustaining surface (118*a*), the load sustaining surface (118*a*) coming in contact with the engagement leg portion (123) in response to the application of a load in a predetermined direction to the outside handle (120) along the extending direction of the outside handle (120), the engagement leg portion (123) being biased in the predetermined direction, the load sustaining surface (118*a*) receiving the load applied from the engagement leg portion (123).

Thus, the reinforcement rib 118 prevents the outside handle 120 from moving in the direction of action of the load.

According to the door handle device 100, the impact generated in response to the pulling of the outside door handle 120 from the initial position to the full stroke position may be prevented without increasing the number of components.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door handle device for a vehicle, comprising:

a frame member configured to be mounted to a door outer panel from an inner side of the vehicle, the door outer panel configuring an outer surface of a vehicle door;

an outside handle being formed in an elongated shape, the outside handle including a first end and a second end; and a seal member being made from an elastic material; wherein the frame member includes a frame-side stopper;

the outside handle includes a handle shaft portion being provided at a portion positioned at the first end, the handle shaft portion serving as a pivot center of the outside handle, the outside handle including an engagement leg portion being provided at a portion positioned at the second end, the engagement leg portion including a handle-side stopper;

the handle shaft portion is mounted to the frame member via a first opening portion being formed at the door outer panel;

the engagement leg portion is mounted to the frame member via a second opening portion being formed at the door outer panel; the outside handle pivoting about the handle shaft portion between an initial position and a full stroke position; the outside handle being prevented from pivoting in a direction opposite to the initial position by an engagement of the handle-side stopper and the frame-side stopper of the frame member in a case where the outside handle is positioned at the full stroke position;

the seal member includes a body portion being configured to be provided at the opening portion of the door outer panel, the body portion sealing the outside handle and the door outer panel, the seal member including an extending portion extending from the body portion to a first region, the first region where the frame-side stopper and the handle-side stopper face with each other;

the extending portion includes a first buffer piece; and the frame-side stopper receives an impact generated in response to a pivot of the outside handle about the handle shaft portion to the full stroke position via the first buffer piece of the extending portion of the seal member, the first buffer piece being positioned at the first region, wherein the extending portion of the seal member includes a second buffer piece being positioned at a second region, the second region being positioned opposite to the first buffer piece, while the first buffer piece and the second buffer piece sandwich the frame-side stopper there between, the extending portion including at least one connection piece connecting the first buffer piece to the second buffer piece, wherein the frame-side stopper of the frame member includes an engagement structure engaging the frame-side stopper to the extending portion of the seal member, wherein the extending portion of the seal member includes the first buffer piece and the second buffer piece extending in parallel with each other along an extending direction of the outside handle, the first buffer piece and the second buffer piece being connected with each other with the connection piece, and wherein the engagement structure is configured by two engagement protrusions of the frame-side stopper, the engagement protrusions being spaced apart from each other while having an engagement groove therebetween, the engagement groove being engaged with the connection piece, the engagement protrusions being sandwiched by the first buffer piece and the second buffer piece.

2. The door handle device for the vehicle according to claim 1, wherein:

the frame-side stopper receives an impact generated in response to a pivot of the outside handle about the handle shaft portion to the initial position of the outside handle via the second buffer piece of the extending portion of the seal member.

3. The door handle device for the vehicle according to claim 1, wherein at least one of the engagement protrusions includes a reinforcement rib, the reinforcement rib extending from a portion receiving the impact generated in response to the pivot of the outside handle about the handle shaft portion to the full stroke position, the reinforcement rib extending from the portion along a direction of action of the impact.

4. The door handle device for the vehicle according to claim 3, wherein the reinforcement rib includes a load sustaining surface, the load sustaining surface coming in contact with the engagement leg portion in response to an application of a load in a predetermined direction to the outside handle along the extending direction of the outside handle, the engagement leg portion being biased in the predetermined direction, the load sustaining surface receiving the load applied from the engagement leg portion.

* * * * *